US007296449B2

(12) United States Patent
Kubacki et al.

(10) Patent No.: US 7,296,449 B2
(45) Date of Patent: Nov. 20, 2007

(54) DRY HYDRAULIC CAN SHAPING

(75) Inventors: Edward F. Kubacki, Marengo, IL (US); John Czamota, Plainfield, IL (US)

(73) Assignee: Ball Corporation, Elgin, IL (US)

( * ) Notice: Subject to any disclaimer, the term of this patent is extended or adjusted under 35 U.S.C. 154(b) by 374 days.

(21) Appl. No.: 10/946,593

(22) Filed: Sep. 21, 2004

(65) Prior Publication Data

US 2006/0060601 A1 Mar. 23, 2006

(51) Int. Cl.
*B21D 26/02* (2006.01)
*B21D 39/08* (2006.01)

(52) U.S. Cl. ..... 72/63; 72/58; 72/62; 29/421.1

(58) Field of Classification Search ..... 72/57–59, 72/61, 62, 63; 29/421.1
See application file for complete search history.

(56) References Cited

U.S. PATENT DOCUMENTS 3,593,551 A * 7/1971 Roth et al. ..... 72/56
3,688,535 A * 9/1972 Keinanen et al. ..... 72/56
3,698,337 A * 10/1972 Brawner et al. ..... 72/379.4
3,757,555 A * 9/1973 Blutt et al. ..... 72/63
3,797,294 A * 3/1974 Roth ..... 72/56
3,807,209 A * 4/1974 Aschberger et al. ..... 72/63
3,842,631 A * 10/1974 Aschberger et al. ..... 72/63
3,857,265 A * 12/1974 Howeler et al. ..... 72/56
5,671,629 A * 9/1997 Valyi ..... 72/58
6,343,496 B1 * 2/2002 Hanna et al. ..... 72/61

* cited by examiner

*Primary Examiner*—David B Jones
(74) *Attorney, Agent, or Firm*—Polster, Lieder, Woodruff & Lucchesi. LC

(57) ABSTRACT

A method for shaping an aerosol container (10) to a desired body contour. A container body (12) is formed into a cylindrical shape and installed into a mold (30) whose inner surface defines the desired body contour. A bladder (74) is fitted onto a tool (50) insertable into an open end (M) of the container body. Once the tool is inserted, the bladder is inflated with a hydraulic fluid. Pressurizing the bladder forces the bladder against a sidewall of the body forcing the body outwardly and deforming it against the inside of the mold. After the container body is shaped, the bladder is de-pressurized and the tool withdrawn leaving the container with a defined body contour. The hydraulic fluid with which the bladder is pressurized is, at all times, contained within the bladder and does not contact the container sidewall so no subsequent drying of the container is required after the shaping process is complete.

10 Claims, 7 Drawing Sheets

DRY HYDRAULIC CAN SHAPING

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to shaped metal containers and the like, and more particularly, to hydraulic shaping of such cans.

Aerosol containers are used to store a fluid or fluent material under pressure and to release the material, as a spray, foam, or gel when a valve is activated. The containers are formed from flat sheets of material which are first cut into rectangular shapes. The resulting blanks are then formed into a cylinder which is open at one end. The container is then filled with the material to be dispensed by the container. A valve assembly is attached to the upper, open end of the container. The contents of the container are subsequently released through a dispensing valve operable by the user of the container.

Current manufacturing processes for aerosol containers have certain drawbacks. A major one is that during fabrication, as the can is being shaped so to have a desired external contour, fluid used in the shaping process comes into contact with the inside of the can. This necessitates a subsequent drying step after can forming is complete so the fluid does not, over time, corrode the sidewall of the can and cause it to deteriorate or fail. The drying operation is performed by heating the container to a temperature sufficient to dry off any fluid adhering to the container after the shaping operation. While this is not a particularly complicated process, it does add manufacturing time and cost to the container.

BRIEF SUMMARY OF THE INVENTION

The present invention is directed to a method of shaping aerosol containers. A method of the invention uses a hydraulic shaping technique in which hydraulic fluids do not come into direct contact with the container thereby eliminating a subsequent drying step in the manufacturing process. Use of this "dry" process thereby reduces the number of manufacturing steps required to produce a can, decreases production time, increases the throughput of containers, and decreases manufacturing costs.

In accordance with the invention, a blank is formed into a cylindrical can body shape, and a dome shaped base is crimped to the bottom of the body. The partially assembled can is now directed to a shaping station where it is installed between a pair of mold halves which define the final contour of the body. A bladder is mounted onto a tool and lowered into the container through an open, mouth end of the container. When the bottom of the tool is seated against the base of the container, a hydraulic fluid is injected into the bladder causing the bladder to expand outwardly against the sidewall of the body. Continued pressurization of the bladder causes continued expansion of the bladder and forces the container sidewall against the inner face of the mold. The pressure causes the container sidewall to distort into the contour shape defined by the inner surface of the mold. Once the container fully conforms to the desired shape, the fluid is evacuated from the container leaving the container body conformed to the desired shape determined by the mold. The tool is then withdrawn. During the forming process, no fluid contacts an interior surface of the container thereby eliminating the need for a subsequent drying operation.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

Figure 1:
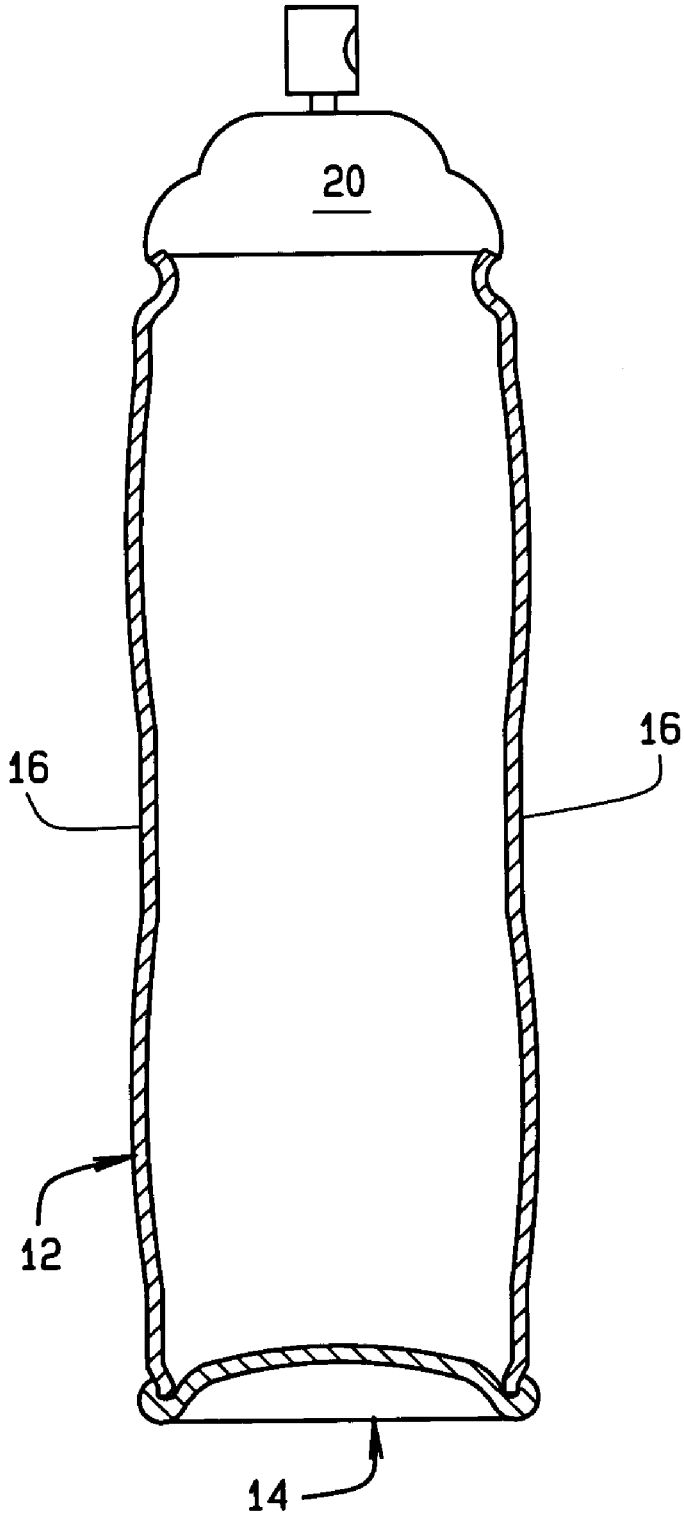
FIG. 1 is an elevation view, partly in section, of an aerosol container having a container body shaped to a desired body contour.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Referring to the drawings, a container such as aerosol dispensing container is indicated generally 10. The container comprises a body 12 initially formed from a blank, as is well-known in the art, and a dome shaped base 14 to which the lower end of the can body is crimped, again as is well-known in the art. Container body 12 is generally cylindrically shaped and initially open at both ends.

The container is a shaped container. As shown in FIG. 1, a central portion of the body has a decreased diameter section 16. As described hereinafter, the can body is shaped during a portion of the manufacturing process. The particular shaping shown in FIG. 1 is exemplary only, and those skilled in the art will understand that other desired shapes can be realized in accordance with the present invention. A valve assembly 20 is attached to the top, open mouth end of the container. The container shown in FIG. 1 is a 3-piece container. It will be understood by those skilled in the art that the can shaping process described herein can also be used with 2-piece containers without departing from the scope of the invention.

Figure 7:
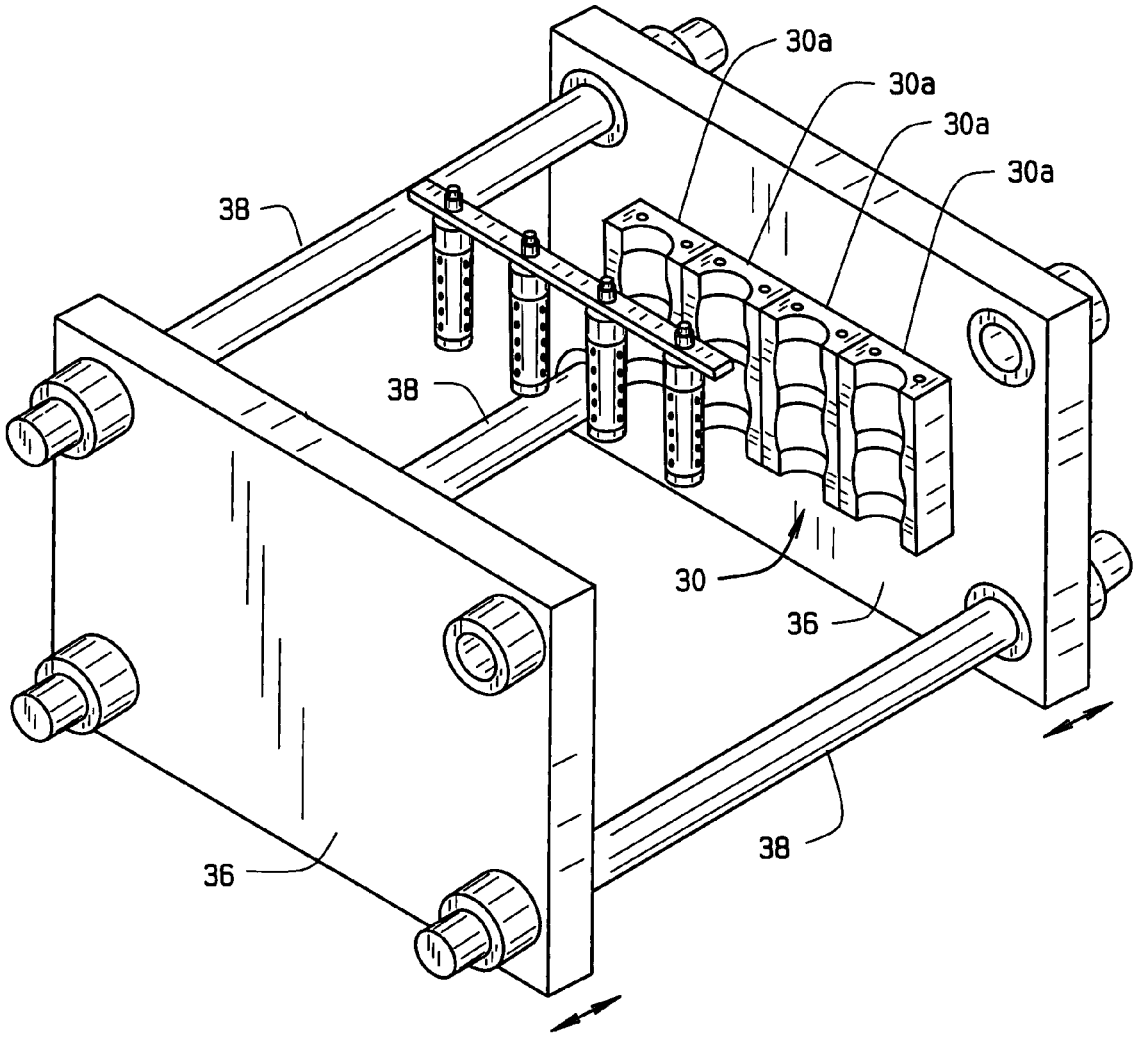

Once a desired container body contour has been decided upon, a mold 30 is made to produce the contour during the manufacturing process. Mold 30 is a multi-piece mold comprising mold halves 30*a* and 30*b*, and a mold base 32. When the three pieces of the mold are brought together, they create a cavity C. Further, mold 30 is fabricated as a multi-cavity mold. As shown in FIG. 7, mold 30 is shown to be a four-cavity mold. It will be understood by those skilled in the art that the mold could have more, or fewer, cavities without departing from the scope of the invention. Each mold half 30*a* and 30*b* is mounted on a movable plate 36 (only mold half 30*a* being shown mounted to a plate 36 in FIG. 7). The plates are, in turn, installed on rods 38 (three of which are shown in FIG. 7) for reciprocal movement toward and away from each other. The inner surface 40*a* and 40*b* of the respective mold halves are formed to produce a desired contour of container 12 as is described hereinafter. As shown in the drawings, the respective mold halves each have identically formed inner surfaces so to form the contour shape shown for container 10 in FIG. 1. That is, a container with a reduced center section 16 intermediate upper and lower sections of a greater diameter. Again, those skilled in the art will appreciate that the shape shown in the drawings is exemplary only and that other contours could be realized by mold 30 within the scope of the invention.

Figure 3:
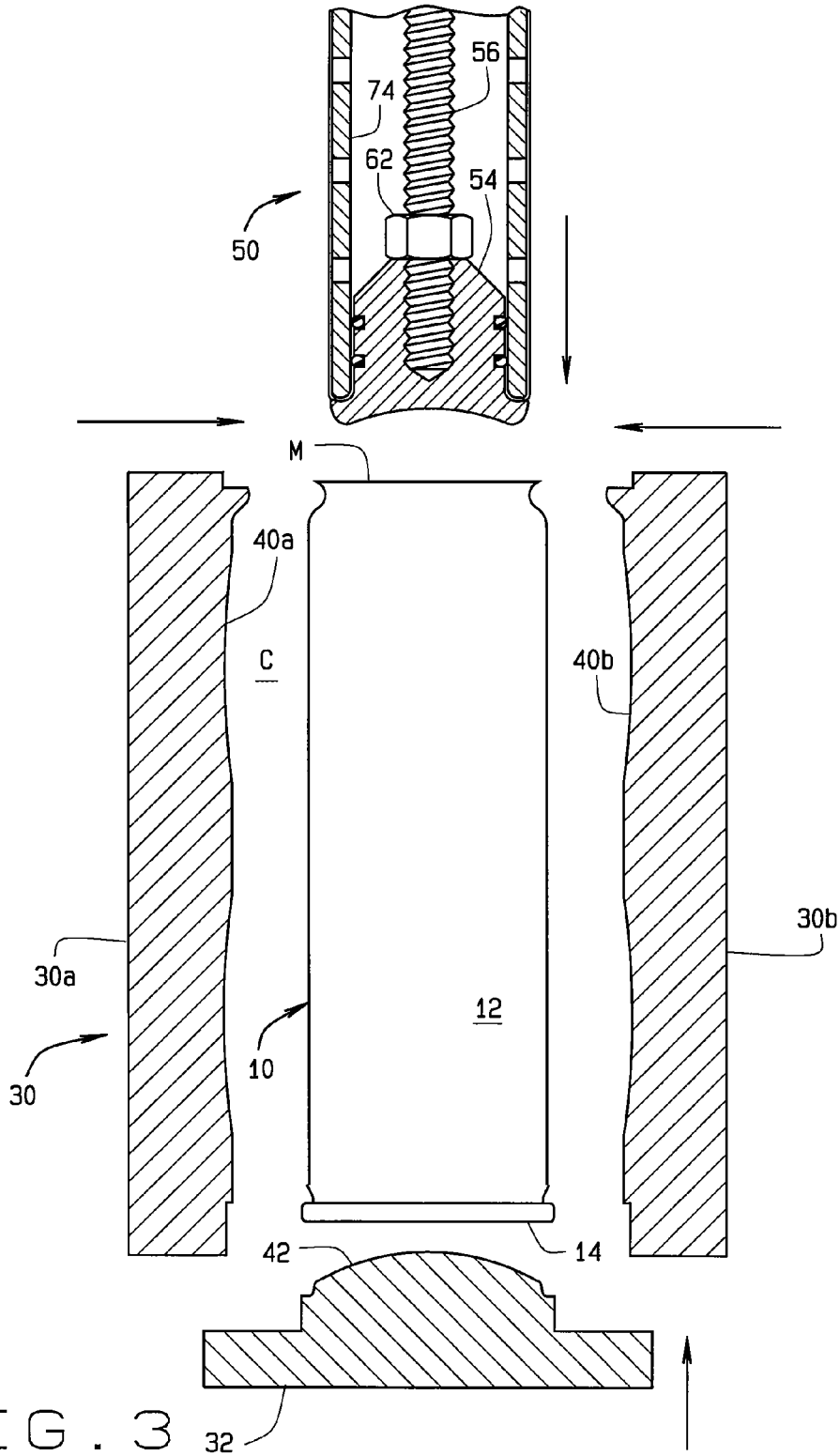
FIGS. 3-6 illustrate the "dry" contour shaping process of the invention; and, FIG. 7 is a perspective view of one-half of a multi-cavity mold for producing containers with contoured bodies.

During the manufacturing process, a blank (not shown) is formed into a cylindrical body shape such as shown in FIG. 3. A dome shaped base 14 is then crimped to the bottom of container body 12. The partially assembled can is now transported to a shaping station where the container is positioned between the mold haves such as shown in FIG. 3. As indicated by the arrows, once container 10 is in place, the two mold halves 30*a*, 30*b* are moved together to encircle the container. At the same time, mold base 32 is moved upwardly into position to seat against the bottom of dome shaped container base 14. The upper dome shaped support surface 42 of base 32 is contoured to approximate the dome shape of base 14. Finally, a tool 50 is lowered into container 10 from above the container.

Figure 2:
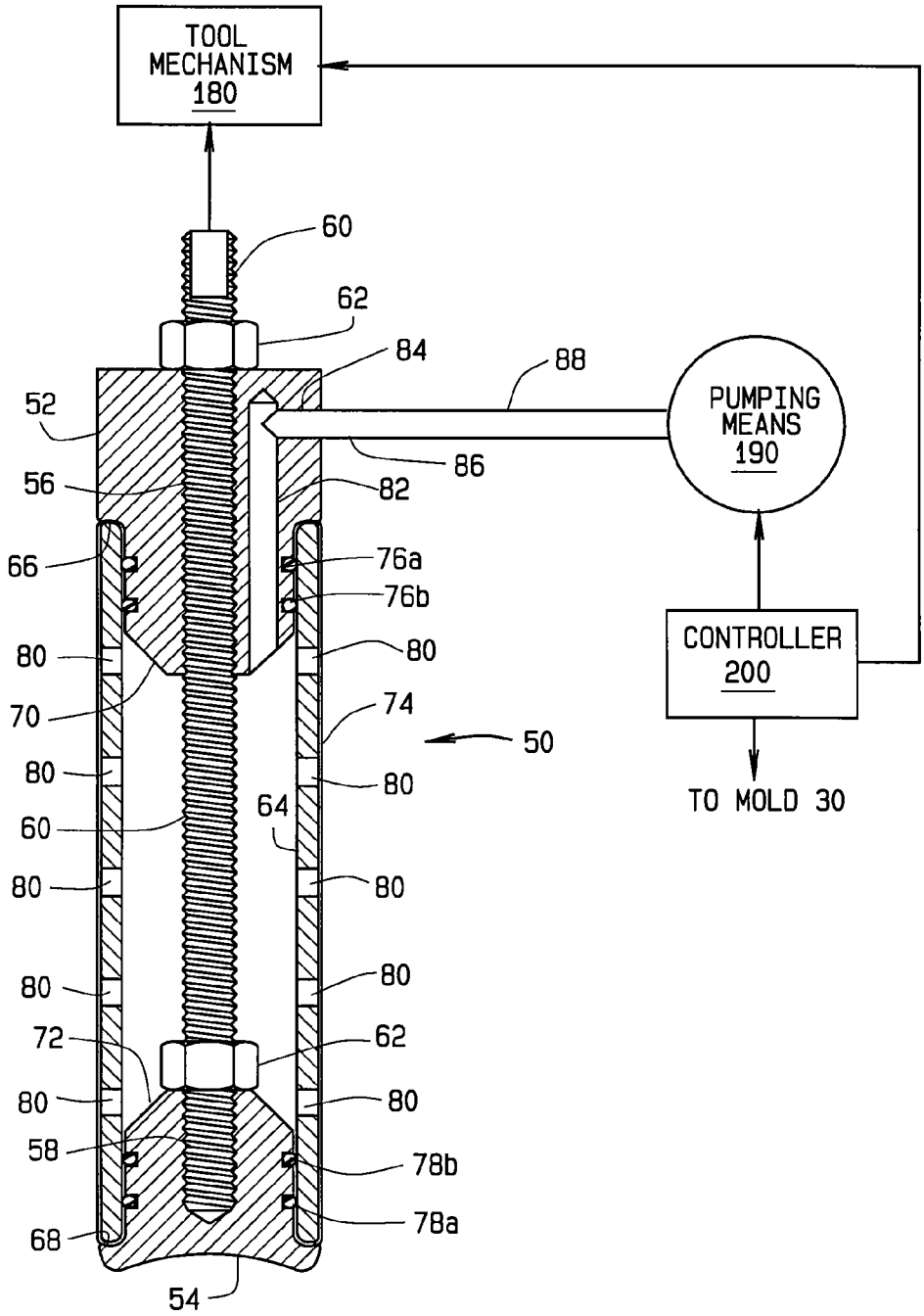
FIG. 2 is an elevation view, partly in section, of a tool used to position a bladder in the container for use in shaping the container body to the desired contour.

Referring to FIG. 2, a tool 50 includes upper and lower tool members 52, 54 respectively. Each member is circular in plan and has a central bore 56, 58 respectively for mounting the member on a threaded shaft 60. The diameter of each member is less than that of the diameter of the mouth formed in the partially assembled container 10, as shown in FIG. 3. This allows the tool to be readily inserted into container 10 through its mouth M.

The position of lower member 54 is fixed on the lower end of shaft 60, while the position of upper member 52 is adjustable. This allows tool 50 to be used with different size molds for containers of different lengths. Once the members are installed on shaft 60, they are locked in place on the shaft using nuts 62. The upper end of shaft 60 is adapted for connection to a mechanism 180 by which the tool is lowered into, and raised from, container 10 in a timed sequence controlled by a controller 200.

A sleeve 64 is sized to be mounted between upper and lower tool members 52, 54. Each tool member has an inwardly extending shoulder 66, 68 respectively, whose width corresponds to the thickness of sleeve 64. Accordingly, the upper and lower ends of the sleeve are seated on the respective shoulders with each end of the sleeve fitting over a reduced diameter shank portion 70, 72 of the respective tool members.

An inflatable bladder 74 is stretched over the outside of sleeve 64. The upper and lower ends of the bladder are over fitted over the top and bottom portions of the sleeve and extend along the inner surface of the sleeve a short distance. The sleeve/bladder assembly is sealed at each end by respective pairs of O-ring seals 76*a*, 76*b* and 78*a*, 78*b*. The sleeve further has a series of spaced openings 80 formed therein for a hydraulic fluid pumped into the space defined by the sleeve and the upper and lower tool members to push against bladder 74 and force it outwardly against a sidewall of container body 12. The number and locations of the openings shown in the drawings are illustrative only.

The bladder is inflated by a hydraulic fluid pumped into the tool to pressurize the bladder. The fluid used for this purpose is a food grade type fluid which is pumped into the bladder and evacuated from the bladder using a pumping means 190 controlled by controller 200. Tool member 52 has a vertical bore 82 extending from the bottom of the tool member upwardly into the member. Bore 82 extends parallel to bore 56. A horizontal bore 84 extends inwardly into member 52 and intersects bore 82 at the upper end of the bore. A nipple 86 is fitted into bore 84 and connects to one end of a pressure hose 88 the other end of which connects to pumping means 190.

Referring to FIGS. 3-6, the sequence of operations for performing the "dry" shaping process of the invention first includes partially completed container 10 being transported to a manufacturing station where mold 30 and tool 50 are located. At this station, the mold halves 30*a*, 30*b* are brought together about the container body (as indicated by the arrows), and mold base 32 is elevated to contact and support the base of the container (as also indicated by an arrow). Simultaneously, tool 50 is lowered by mechanism 180 (as indicated by the arrow) into mouth M of the container until the bottom of lower tool member 54 contacts the bottom of the container. The resulting configuration is as now shown in FIG. 4.

Figure 4:
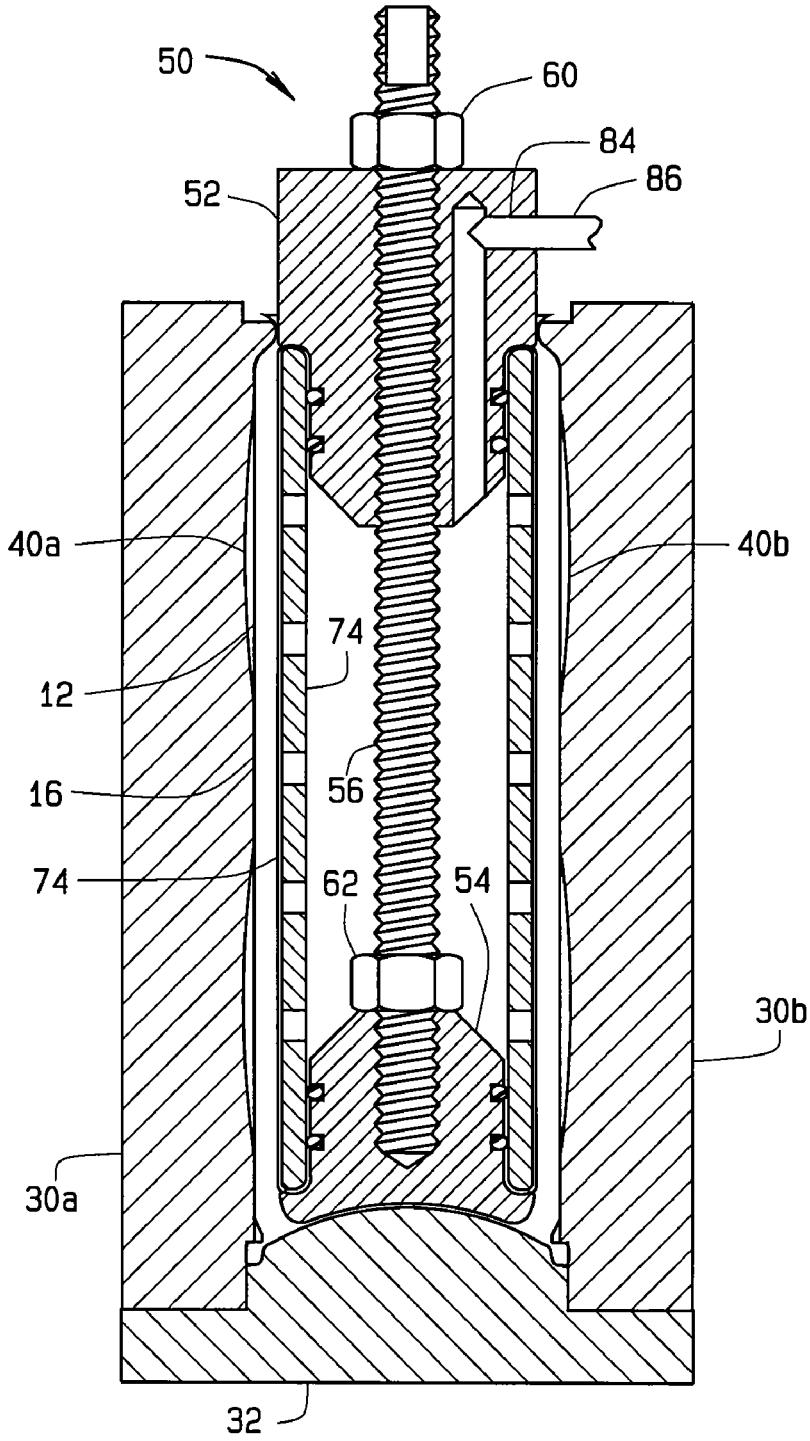

In FIG. 4, it will be noted that the sidewall of container body 12 contacts the inner surface of the mold halves throughout the center section 16 of the container body, but that the mold is formed so that its upper and lower segments are spaced away from the upper and lower sections of the container body. At this time, bladder 74 is unpressurized. Those skilled in the art will appreciate that FIG. 4 is illustrative only, and that, depending upon the can shape desired, various sections of a container, will be in contact with, or spaced away from, the mold surfaces.

Figure 5:
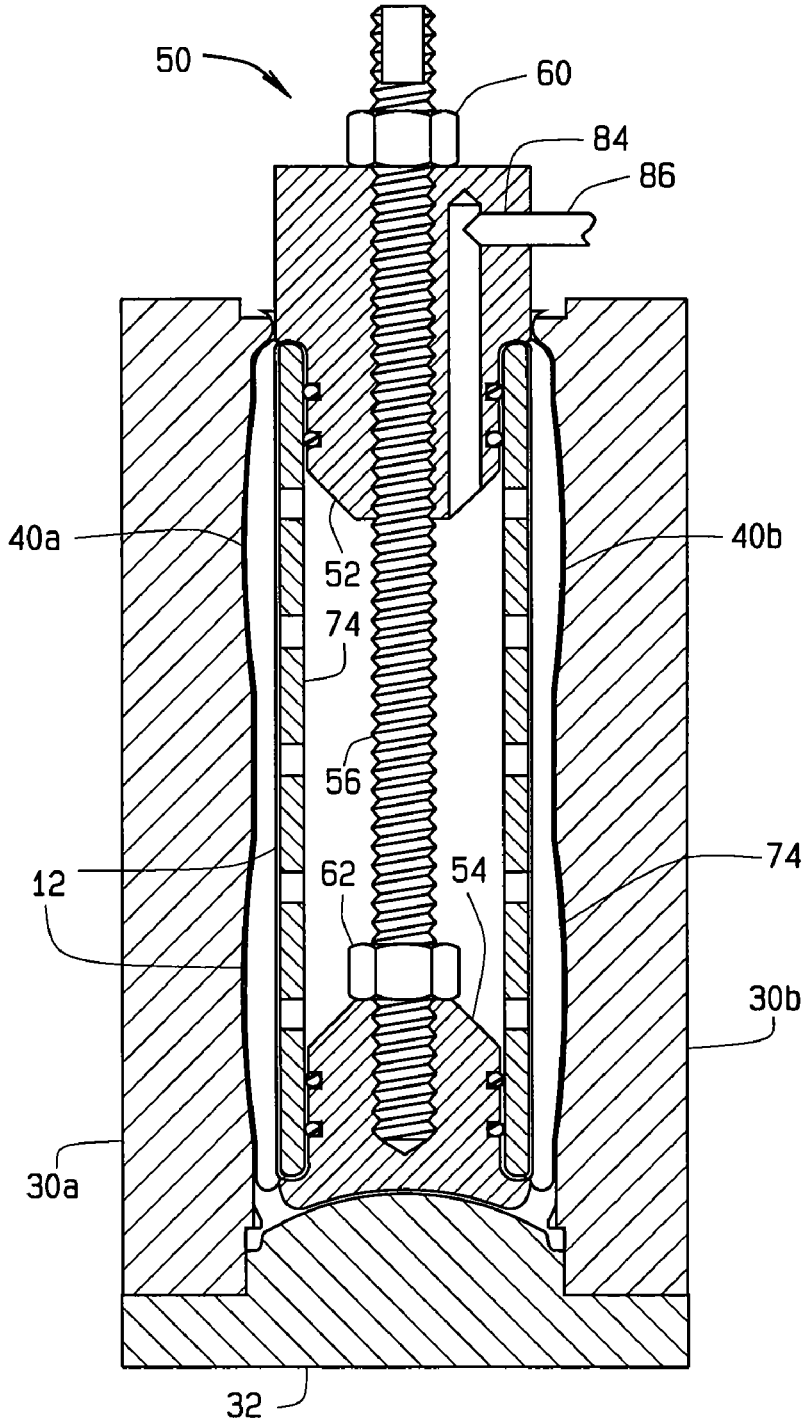

Now, as shown in FIG. 5, controller 200 activates pumping means 190 to pump fluid into tool 50 to inflate the bladder. As the bladder is inflated, it expands uniformly outwardly pressing against the sidewall of container body 12 and pushing it outwardly against the inside surface of mold 30. The upper and lower sections of the container body expand outwardly due to the force of the expanding bladder, but center section 16 of the body is constrained by the mold surface and cannot expand. The deformation of the upper and lower sections of body 12 against the mold create the desired container contour defined by mold 30.

Figure 6:
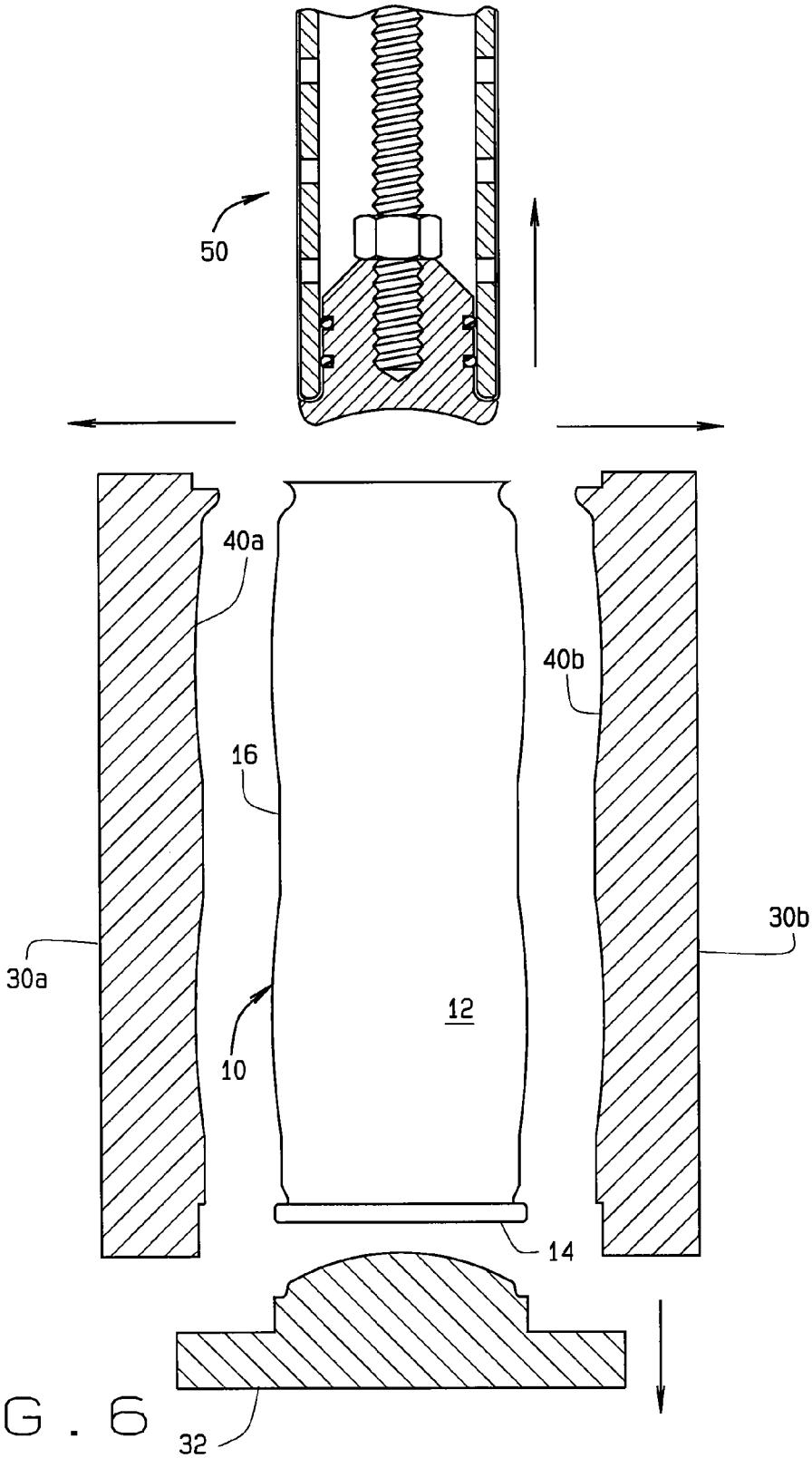

After the bladder has been pressurized to a level sufficient that it expands enough to compress the container sidewall against the inside surface of mold 30, controller 200 activates the pumping means to evacuate the hydraulic fluid from tool 50, deflating the bladder so it draws inwardly against sleeve 64. However, body 12 of container 10 remains in its deformed position Finally, as shown in FIG. 6, once bladder 74 is depressurized, controller 200 operates mechanism 180 to withdraw tool 50 out of the mouth of the container. Mold halves 30*a* and 30*b* now separate (as indicated by the arrows), and mold base 32 is withdrawn from the bottom of the container. Container 10 now has the desired body contour defined by the mold with upper and lower body sections which are greater in diameter than center section 16 of the container body. It is important to note that during the shaping operation, the hydraulic fluid with which bladder 74 is inflated is contained within the bladder at all times. None of the fluid comes into contact with the container sidewall, at any time, so no subsequent drying of the container is now required once the shaping process is complete.

After the shaping step, the container is moved to a new station where valve 20 is connected to the mouth of the container by crimping, for example. Finally, the container is filled with fluent material dispensed by the container.

In view of the above, it will be seen that the several objects and advantages of the present invention have been achieved and other advantageous results have been obtained.

Having thus described the invention, what is claimed and desired to be secured by Letters Patent is:

1. A method for shaping a body of an aerosol container to a desired body contour comprising:

forming a container body into a cylindrical shape;

installing the container body into a mold whose inner surface defines the desired body contour;

attaching an inflatable bladder about a tool insertable into an open end of the container body, the tool including an elongated sleeve over which the bladder is fitted with respective ends of the sleeve seated on respective upper and lower members of the tool, one of which members being adjustable relative to the other so the tool can be used to shape containers of different lengths; and, inserting the tool into the container body and inflating the bladder with a hydraulic fluid once the tool is positioned in the body, inflating the bladder pushing the bladder against a sidewall of the body to force the body outwardly against the mold for the sidewall to conform to the desired contour defined by the mold.

2. The method of claim 1 further including evacuating the fluid from the bladder to deflate the bladder, the contour of the container body remaining in its conformed shape after the bladder is deflated, and withdrawing the tool from the container body after the bladder is deflated.

3. The method of claim 2 in which the hydraulic fluid with which the bladder is inflated is contained within the bladder and does not contact the container sidewall so no subsequent drying of the container is required after the shaping process is complete.

4. The method of claim 1 including a multi-cavity mold so a plurality of container bodies can be shaped at one time.

5. The method of claim 4 in which the mold is a split mold portions of which are brought together to enclose the container body prior to a shaping operation.

6. The method of claim 1 in which the sleeve is sealingly attached to the tool members to prevent leakage of the fluid when the bladder is inflated.

7. The method of claim 6 in which one of the tool members includes a passage for injecting hydraulic fluid into the tool to inflate the bladder.

8. The method of claim 7 in which the sleeve has openings therein by which injected hydraulic fluid bears against the bladder to push it outwardly against the sidewall of the container body and force the body against a container shaping surface of the mold.

9. The method of claim 8 in which the openings are uniformly spaced along a length of the sleeve.

10. The method of claim 1 in which the tool includes a threaded shaft on which the upper and lower members are mounted, one of the members being fixed in place on one end of the shaft, and the other member being movable along the shaft relative thereto, so to adjust the spacing between the members.

* * * * *